US007896225B2

(12) United States Patent
Bray et al.

(10) Patent No.: US 7,896,225 B2
(45) **Date of Patent: *Mar. 1, 2011**

(54) SMOKING ARTICLE PACK BLANK(S)

(75) Inventors: Andrew Jonathan Bray, Southampton (GB); Alan Douglas Tearle, Southampton (GB); Steven Holford, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 718 days.

This patent is subject to a terminal disclaimer.

(21) Appl. No.: 10/548,779

(22) PCT Filed: Mar. 8, 2004

(86) PCT No.: PCT/GB2004/000953

§ 371 (c)(1),
(2), (4) Date: Jun. 6, 2006

(87) PCT Pub. No.: WO2004/080844

PCT Pub. Date: Sep. 23, 2004

(65) Prior Publication Data

US 2006/0255111 A1 Nov. 16, 2006

(30) Foreign Application Priority Data

Mar. 12, 2003 (GB) ..... 0305661.1

(51) Int. Cl.
*B65D 43/16* (2006.01)
*B65D 5/00* (2006.01)

(52) U.S. Cl. ..... 229/146; 229/160.1; 206/242

(58) Field of Classification Search ..... 229/146, 229/160.1, 87.12, 87.14, 902, 906; 206/271, 206/242, 265, 266, 267, 270, 247; 220/836, 839; 53/462, 444; 131/283
See application file for complete search history.

(56) References Cited

U.S. PATENT DOCUMENTS

| | | | | |
|---|---|---|---|---|
| 3,204,852 | A | 9/1965 | Capucio | |
| 3,877,632 | A * | 4/1975 | Steel | 229/104 |
| 4,375,260 | A * | 3/1983 | Focke et al. | 206/264 |
| 4,955,527 | A * | 9/1990 | Blackman et al. | 229/114 |
| 5,160,024 | A * | 11/1992 | Evers | 206/268 |
| 5,946,890 | A * | 9/1999 | Focke et al. | 53/466 |
| 6,220,430 | B1 * | 4/2001 | Boriani et al. | 206/268 |
| 6,343,691 | B1 * | 2/2002 | Focke et al. | 206/268 |

FOREIGN PATENT DOCUMENTS

| | | |
|---|---|---|
| CN | 11424559 | 2/1997 |
| GB | 962761 | 7/1964 |
| WO | WO 02/076247 | 10/2002 |

* cited by examiner

*Primary Examiner* — Nathan J Newhouse
*Assistant Examiner* — Christopher Demeree
(74) *Attorney, Agent, or Firm* — Charles I Sherman; Middleton Reutlinger

(57) ABSTRACT

A smoking article pack blank having a lid (2) and a base portion (3), the lid and the base portion being interconnected along a hinge line (27) and the base portion comprising first (24) and second (25) main panels. The main panels of the smoking article pack blank each having side panels (32, 33, 38, 39) depending therefrom and at least one of the side panels having a side flap (35) depending therefrom. When erected the smoking article pack blank may be hinged about a longitudinal axis (34) of a side wall thereof. The invention further provides a smoking article pack assembly, which pack assembly comprises the smoking article pack blank and a plurality of inner blanks. The smoking article pack assembly may be hinged into an open position thereof about a longitudinal hinge line in a side wall of the erected pack assembly.

34 Claims, 6 Drawing Sheets

11
7
8
2
13
12
4
15
14
10
23
22
6
21
9
20
17
5
16
19
18
27
1
24
36
37
38
39
3
26b
28
43
40
42
26a
33
29
34
41
35
25
30
31
32

SMOKING ARTICLE PACK BLANK(S)

CROSS REFERENCE TO PRIOR APPLICATION

This application is a national stage filing (35 U.S.C. 371) of PCT/GB2004/000953, filed on Mar. 8, 2004, which claims priority to and benefit from Great Britain Patent Application No. 0305661.1, filed on Mar. 12, 2003.

The present invention relates to a smoking article pack blank(s), particularly but not exclusively for cigarettes.

Multi-compartment packs for cigarettes are already known in the art. For example, FR2614720 discloses a pack comprising a plurality of articulated compartments, which compartments are closed by means of a single interlocking lid. The patent does not disclose a blank from which the pack may be assembled, however, it is clear from the specification of FR2614720 that the pack is not of a form that could readily be assembled using conventional, or little modified, pack assembly machinery.

The present invention has as an aim the provision of smoking article pack blank(s) which blank is easy to assemble at the high manufacturing speeds required in the tobacco industry.

A further aim of the present invention is to provide a blank(s) which may be assembled using conventional pack assembly machinery, or at least a blank which may be assembled on machinery requiring little modification from conventional pack assembly machinery.

The present invention provides a smoking article pack blank, the blank comprising a lid portion and a base portion, the lid portion and the base portion being interconnected along a hinge line and the base portion comprising a first main panel, a second main panel and a bottom panel, each panel being defined by longitudinal side margins, the first and the second main panels each having side panels, which side panels depend from the longitudinal margins of the first and second main panels, at least one of the side panels having a side flap depending from a longitudinal margin thereof.

Preferably the side flap is connected to the adjacent side panel by a hinge line.

Preferably each panel has a top margin and a bottom margin.

It is much by preference that the bottom panel of the smoking article pack blank comprises at least two bottom panel sections. Advantageously the bottom panel comprises two bottom panel sections.

Preferably the bottom panel sections may be joined along a line of weakening. In an alternative arrangement the bottom panel sections may be integral with one another.

When the bottom panel sections are joined along a line of weakening, the line of weakening preferably extends between the longitudinal margins of the bottom panel. Advantageously the line of weakening extends between the opposing longitudinal margins of the bottom wall, the line of weakening extending up to but not through the longitudinal margins of the bottom wall. It is much by preference that the line of weakening in the bottom panel extends between the longitudinal margins of the bottom panel in parallel relation to the top margin and/or the bottom margin of the bottom panel.

Advantageously the line of weakening is a line of perforation.

In the alternative arrangement, wherein the bottom panel sections are integral with one another, it is much by preference that the bottom panel sections are separable from one another. Suitably the bottom panel sections are separable from one another by cutting along a line of integration between the two bottom panel sections. It is much by preference that the line of integration extends between the opposing longitudinal margins of the bottom panel. Even more preferably the line of integration extends between the opposing longitudinal margins of the bottom panel in parallel relation to the top margin and/or the bottom margin of the bottom panel.

Advantageously the bottom panel has a depth dimension and the side panels have width dimensions substantially equal to a multiple of the diameter of a smoking article. If the smoking articles are in nested arrangement within an erected pack, the depth dimension of the bottom panel and the width dimensions of the side panels of the smoking article pack blank may be slightly less than a multiple of the diameter of a smoking article. When referred to herein, multiple shall be taken as including one. Preferably the width dimension of each of the side panels depending from a main panel of the smoking article pack blank is substantially equal to the depth dimension of that bottom panel section adjacent to that main panel, which bottom panel section is delimited by the line of weakening or the line of integration in the bottom panel. Suitably the panels of the smoking article pack blank have a common longitudinal axis.

Advantageously the total depth dimension of the bottom panel is equal to the sum of the width of a side panel depending from a longitudinal margin of the first main panel and the width of a side panel depending from the longitudinal margin of the second main panel.

Preferably the hinge line connecting the side flap and the side panel is formed from the common longitudinal margin between the side flap and the side panel adjacent thereto.

Preferably the side flap depends from the outer longitudinal margin of the adjacent side panel.

Advantageously the side flap depends from the outer longitudinal margin of a side panel of the second main panel of the base portion of the smoking article pack blank. When the smoking article pack blank is erected, the side flap overlaps a side panel of the other main panel of the blank. Alternatively, the side panel of the other main panel may overlap the side flap when the blank is erected.

It is much by preference that the side flap overlaps a side panel of the first main panel of the base portion of the smoking article pack blank. Advantageously, the side panel and the overlapping side flap are of substantially equal width dimensions. When the smoking article pack blank is erected it is much by preference that the longitudinal margin of the side panel from which margin the side flap depends forms a longitudinally extending hinge line in a side wall of the erected blank. The longitudinal margin of the overlapping side panel adjacent the longitudinally extending hinge line allows the erected blank to-hinge thereabout.

Preferably the smoking article pack blank is an outer blank. As referred to herein an 'outer blank' is a blank which may be assembled about an erected inner blank or a plurality of inner blanks or, alternatively may be assembled about an assemblage of smoking articles which assemblage is wrapped in a wrapping material.

In a second embodiment of the present invention, the smoking article pack blank base portion comprises two side flaps, which side flaps depend respectively from the longitudinal margins of the first and second side panels of one of the main panels of the blank. Preferably the side flaps depend from the outer longitudinal margins of the first and second side panels of the second main panel of the blank.

When the smoking article pack blank is erected it is much by preference that the longitudinal margins of the side panels from which margins the side flaps depend form longitudinally extending hinge lines in each of the side walls of the erected blank. The longitudinal margins of the overlapping side panels adjacent the longitudinally extending hinge lines allow the erected blank to hinge thereabout.

In the second embodiment of the present invention the smoking article pack blank base portion further comprises a second line of weakening, which second line of weakening extends longitudinally from the top margin of the second main panel to the bottom margin of the second main panel.

Preferably the second line of weakening extends longitudinally in substantially parallel relation to the longitudinal side margins of the second main panel of the smoking article pack blank. In addition, the second line of weakening extends across the bottom margin of the second main panel, into the bottom panel of the smoking article pack blank. Preferably the bottom margin of the second main panel has a line of weakening thereacross. It is much by preference that the second line of weakening extends up to but does not intersect with, or extend beyond, the line of weakening extending transversely across the bottom panel of the bottom panel. Preferably the second line of weakening is located along the central longitudinal axis of the second main panel and the bottom panel of the blank.

Preferably the second line of weakening is a line of perforation.

It will be understood that in an alternative arrangement of the second embodiment of the present invention, the second line of weakening could alternatively be a line of integration.

It will be apparent to the skilled artisan that the second embodiment of the present invention may equally comprise a line of weakening and a line of integration in combination. For example, the second line of weakening may be replaced by a line of integration whilst there remains a line of weakening in the bottom panel of the smoking article pack blank. Likewise the line of weakening in the bottom panel of the smoking article pack blank may be replaced by a line of integration whilst the pack blank further comprises a second line of weakening.

In the alternative arrangement of the second embodiment of the present invention the second line of integration separates the second main panel of the smoking article pack blank into two second main panel sections. Preferably the two second main panel sections are separable from one another line the line of integration. It will be understood the separation of the two second main panel sections along the line of integration may be by cutting, for example, along the line of integration.

The present invention may further provide a smoking article pack assembly comprising plurality of inner blanks, which inner blanks may be used in combination with a smoking article pack blank of the present invention. When erected, each inner blank is capable of enwrapping a bundle of smoking articles.

Preferably the inner blanks are formed separately from the smoking article pack blank of the present invention. Alternatively, the inner blanks may be formed as an integral part with the smoking article pack blank.

It is much by preference that an inner blank comprises at least one main panel. More preferably the inner blank comprises two main panels. Advantageously the two main panels of the inner blank are interconnected by a bottom panel.

It is much by preference that at least one of the main panels of the inner blank has a cut-out portion in a top margin thereof. Preferably the cut-out portion is of a depth which allows access to, and easy removal of, smoking articles held within the inner blank when the inner blank is erected.

When the smoking article pack blank is assembled about a plurality of inner blanks, one main panel of each of the inner blanks is fixed to a main panel of the smoking article pack blank, the other main panel of each of the inner blanks is exposed when the line(s) of weakening and/or the line of integration of the smoking article pack blank is broken and/or cut and the smoking article pack blank is opened about a hinge line in the side wall thereof.

The assembled smoking article pack is retained in a closed position until first opening by the consumer by means of the lid portion and the unbroken line(s) of weakening of the assembled smoking article pack blank. Once the consumer has broken the line(s) of weakening on first opening of the assembled pack, the pack may be re-closed by means of the lid portion of the assembled smoking article pack blank.

Alternatively the line of weakening and/or line of integration may be broken or cut before the erected pack has reached the consumer.

It will be readily understood by a person skilled in the art that in the second embodiment of the present invention, the erected smoking article pack blank comprises two longitudinally extending hinge lines in the side walls thereof. It will be further understood that the second embodiment of the present invention provides a smoking article pack blank comprising two lines of weakening, one of which lines of weakening extends transversely across the bottom panel of the smoking article pack blank between the longitudinal margins thereof, the other line of weakening extends longitudinally between the top margin of the second main panel of the smoking article pack blank and the first line of weakening in the bottom panel of the smoking article pack blank.

The blank of the present invention may be utilised in forming packs of varying dimensions and shapes. The present invention may, for example, provide blanks with square, round or bevelled longitudinal margins. Furthermore the present invention may be utilised, for example, in forming packs having the dimensions known in the art as International, King Size, SuperKing or Jumbo Carton. Preferably the smoking article pack blank of the present invention may be erected to form a hinged-lid pack. The present invention may also be used in combination with the inventive concept disclosed in our co-pending patent application WO 03/078724.

A smoking article pack assembled from the outer and inner blanks of the present invention may be overwrapped with, for example, a cellophane wrapper. It is much by preference that the cellophane wrapper has a tear strip for easy removal thereof by the consumer. Advantageously the tear strip is located such that the consumer must remove the entire cellophane wrapper in order to gain access to the pack and the smoking articles contained therein. The tear strip may, for example, be located about the lid portion of the assembled pack. Alternatively the tear strip may be located in longitudinal orientation about the assembled pack.

The present invention further provides a method of assembly of a smoking article pack, which smoking article pack is assembled from an outer smoking article pack blank of the present invention and a plurality of inner blanks, the method of assembly comprising wrapping a bundle of smoking articles in a wrapper, feeding an inner blank to a pack assembly machine, partially erecting the inner blank, plunging the wrapped bundle of smoking articles into the partially erected inner blank, completely erecting the inner blank about the wrapped bundle of smoking articles, feeding an outer blank to the pack assembly machine, which outer blank is partially erected before two or more erected inner blanks are plunged into the outer blank, and completely erecting the outer blank about the inner blanks.

Preferably the method of assembly may be performed using one or more pack assembly machines. Most preferably the method of assembly requires one pack assembly machine.

Preferably the smoking article pack is assembled from an outer smoking article pack blank of the present invention in combination with inner blanks of the present invention.

In order that the present invention be easily understood and readily carried into effect, reference will now be made, by way of example, to the accompanying diagrammatic drawings in which.

Features common to more than one Figure will be denoted by the same reference numeral.

Figure 1:
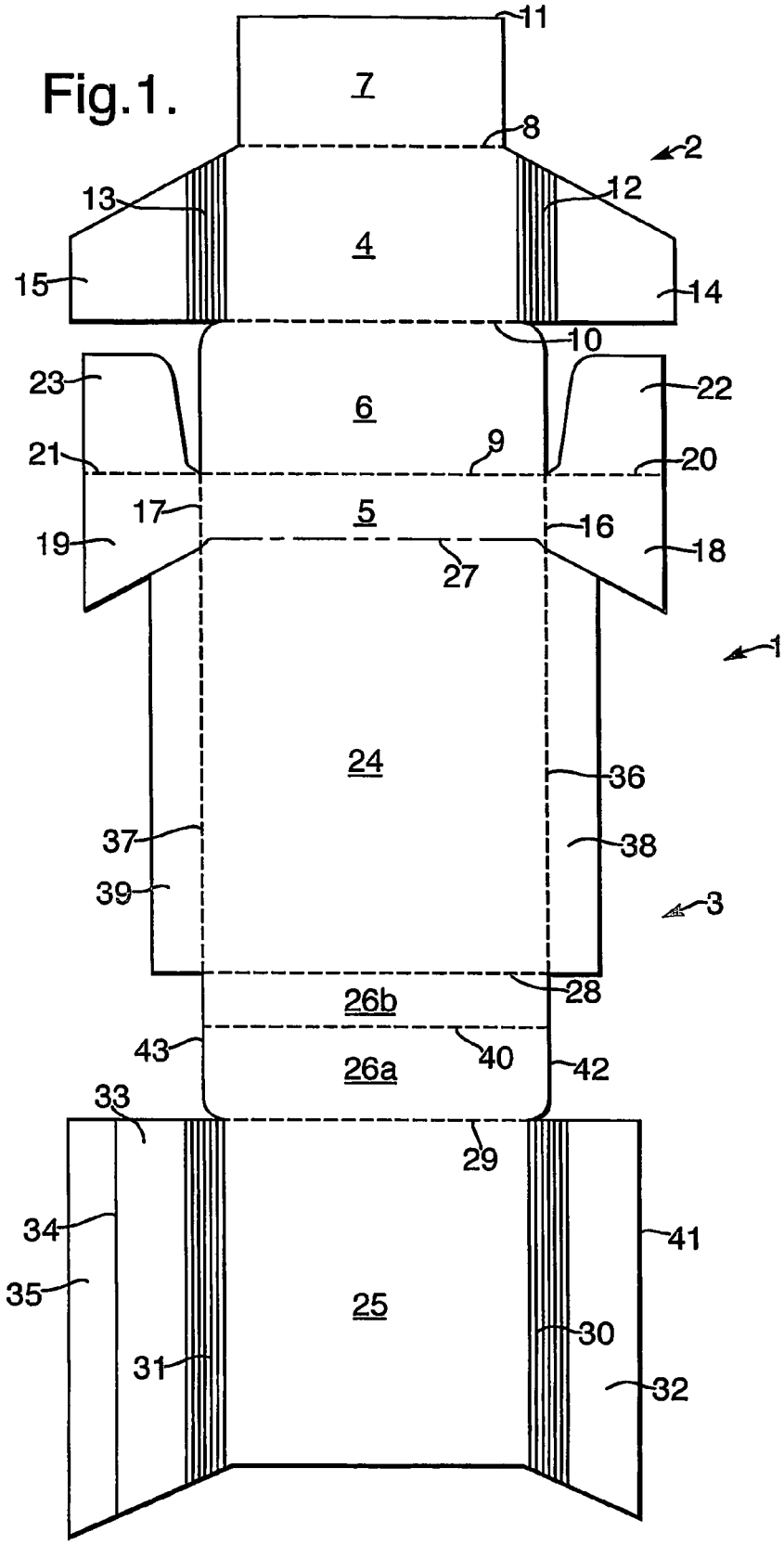
FIG. 1 shows a smoking article pack outer blank according to one embodiment of the present invention.

FIG. 1 shows an outer blank 1 according to one embodiment of the present invention. Outer blank 1 has a lid portion 2 and a base portion 3. The lid portion 2, comprises a front panel 4, a back panel 5, a top panel 6 and a front inner panel 7. Each of the panels 4, 5, 6 and 7 has a top margin 8, 9, 10, 11 respectively. In the embodiment of the present invention shown in FIG. 1, top margins 8, 9, and 10 also form the bottom margins of the front inner panel 7, the top panel 6 and the front panel 4 respectively.

The lid portion 2 further comprises longitudinal margins 12 and 13 from which margins depend side panels 14 and 15 respectively. Back panel 5 has longitudinal margins 16 and 17. Inner side panels 18 and 19 depend from the back panel longitudinal margins 16 and 17. The inner side panels 18 and 19 have top margins 20 and 21 respectively, which top margins form the bottom margins of inner top panels 22 and 23.

Outer blank base portion 3 has a first main panel 24, a second main panel 25 and a bottom panel 26*a*, 26*b*. The base first main panel 24 is interconnected with lid back panel 5 along hinge line 27. The first main panel of the base portion is connected to the bottom panel 26*a*, 26*b* along margin 28 and the bottom panel 26*a*, 26*b* is further connected to the second main panel along margin 29.

The outer blank second main panel 25 has longitudinal margins 30 and 31 from which margins depend side panels 32 and 33 respectively. Side flap 35 depends from the outer longitudinal margin 34 of side panel 33. In an alternative arrangement, side flap 35 may depend from the outer longitudinal margin 41 of side panel 32.

The first main panel 24 has longitudinal margins 36 and 37. Side panels 38 and 39 depend from longitudinal margins 36 and 37 respectively.

Bottom panel 26 has a line of perforation 40 extending between longitudinal margins 42 and 43 thereof.

When the outer blank 1 is erected, side flap 35 lies against the inner face of side panel 39. Alternatively, side flap 35 may lie against the outer face of side panel 39. Side flap 35 is then fixed in position, for example by gluing, to side panel 39. Longitudinal margin 34 then forms a hinge line thus allowing the erected outer blank 1 to hinge about that hinge line. The sum of the widths of side panels 32 and 38, including scoring (if present), is equal to the depth of the erected outer blank. The sum of the widths of side panels 32 and 38, including scoring (if present), is equal to the length of each of the bottom panel longitudinal margins 42 and 43. The length of longitudinal margins 42 and 43 is equal to a multiple of the diameter of a smoking article, unless the smoking articles are in nested arrangement when the length of each of the longitudinal margins 42 and 43 will be slightly less than a multiple of the diameter of a smoking article.

The width of each of side panels 32 and 33, including scoring (if present), is equal to the length of the longitudinal margin of bottom panel portion 26*a*. The width of each of side panels 38 and 39, including scoring (if present), is equal to the length of the longitudinal margin of bottom panel portion 26*b*.

FIG. 1 shows an outer blank 1 having round longitudinal margins. Outer blank 1 may alternatively have square or bevelled longitudinal margins.

Figure 2:
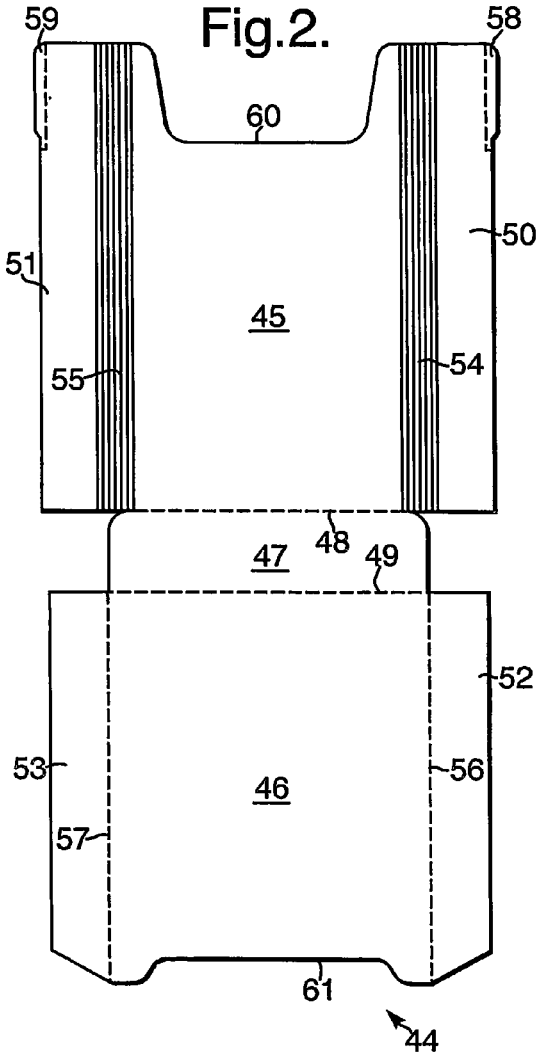
FIG. 2 shows an inner blank to be used in combination with the outer blank of FIG. 1.
Figure 3:
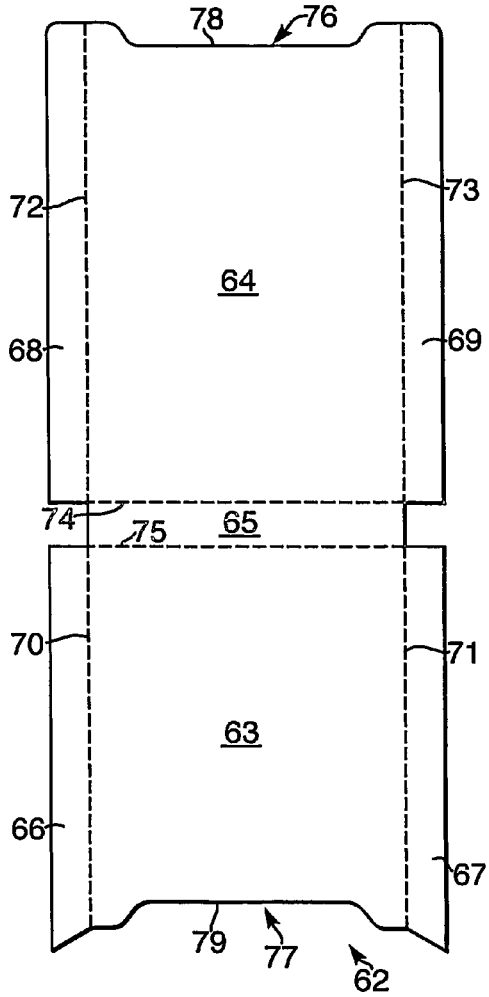
FIG. 3 shows a second inner blank to be used in combination with the outer blank of FIG. 1 and the inner blank of FIG. 2.

The outer blank 1 shown in FIG. 1 may be used in combination with the inner blanks shown in FIGS. 2 and 3. In FIG. 2, inner blank 44 comprises main panels 45 and 46 and a bottom panel 47. Main panel 45 is connected to bottom panel 47 along margin 48. Main panel 46 is connected to bottom panel 47 along margin 49. The inner blank 44 further comprises side panels 50, 51, 52 and 53, the side panels depending from the longitudinal margins 54, 55, 56 and 57 of the main panels 45 and 46 respectively. The inner blank has lugs 58 and 59, which lugs retain the lid portion 2 of outer blank lin a closed position when the pack is fully erected. Inner blank 44 has cut-out sections 60 and 61. Cut-out section 60 allows the consumer access to the smoking articles retained by the erected inner blank.

Inner blank 44 is positioned within outer blank 1 such that the main panel 45 of inner blank 44 lies against the inner surface of the second main panel 25 of the outer blank 1. The inner blank 44 may then be fixed in place, for example, by gluing. It is preferable that inner blank 44 should be erected and filled with smoking articles before being fixed to outer blank 1.

FIG. 3 shows a second inner blank 62 for use in combination with the outer blank 1 of FIG. 1 and the inner blank 44 of FIG. 2. Second inner blank 62 has main panels 63 and 64, and a bottom panel 65. Main panels 63 and 64 have side panels 66, 67, 68 and 69, which side panels depend from longitudinal margins 70, 71, 72 and 73 respectively. Main panel 64 is connected to bottom panel 65 along margin 74 and main panel 63 is connected to bottom panel 65 along margin 75.

Cut-out sections 76 and 77 are provided in the top margins 78 and 79 of main panels 64 and 63.

When erected, inner blank 62 enwraps a bundle of smoking articles, inner blank 62 is then placed onto outer blank 1 such that main panel 64 lies against the inner surface of the outer blank first main panel 24. Outer blank 1 is then erected about inner blanks 44 and 62.

The smoking article pack formed when the outer and inner blanks are erected may then be wrapped in an outer wrapper, for example cellophane. A tear-strip is then provided to allow the consumer to remove the outer wrapper from the assembled pack. The line of perforation 40 is then broken there along and the lid hinged along hinge line 27, therefore providing access to the outer surfaces of panels 46 and 63. Panels 46 and 63 may be used to provide information to the consumer. Alternatively, panels 46 and 63 may be printed with graphics and/or indicia, the surfaces being visible to the consumer when the erected pack is in an open position.

Figure 4:
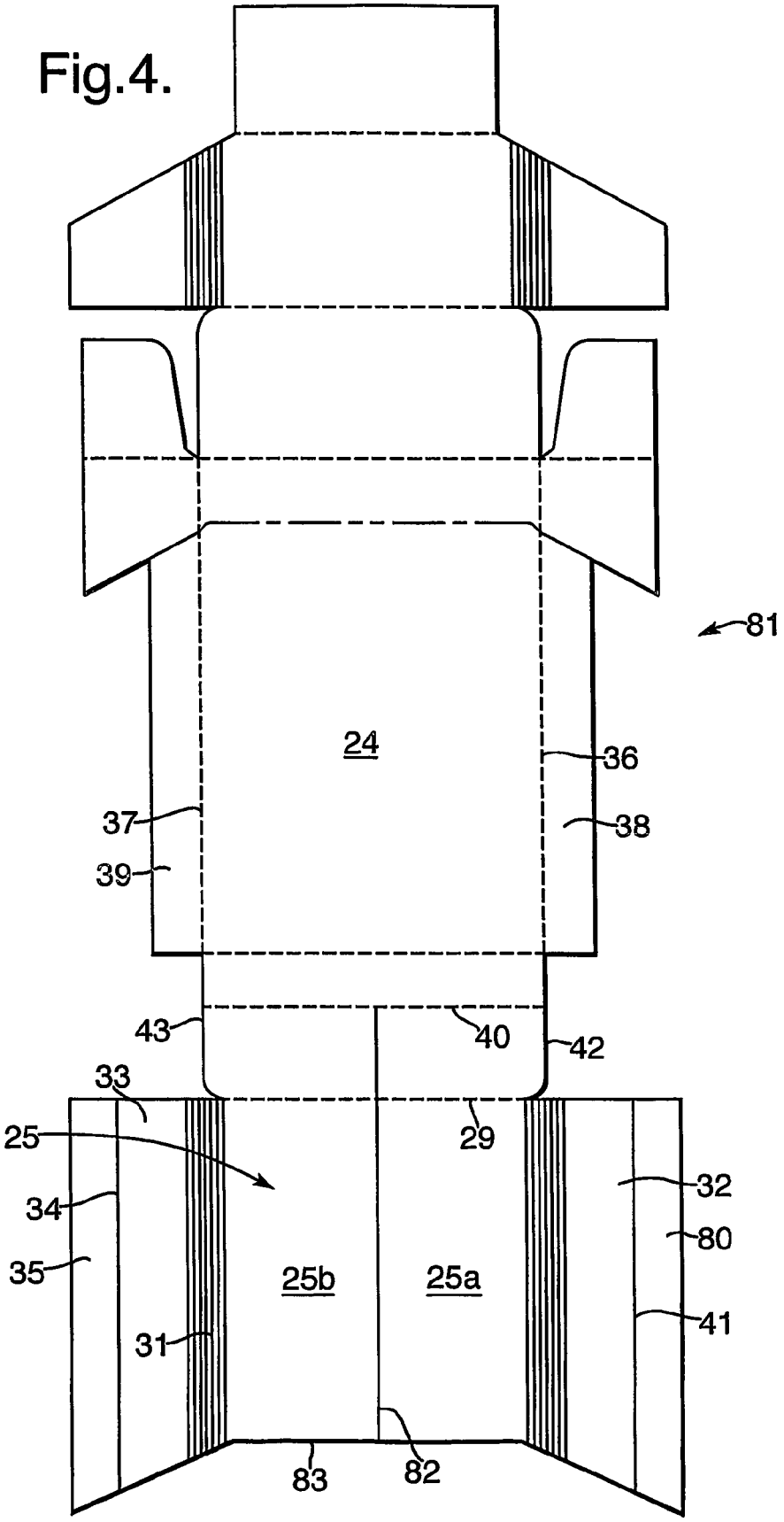
FIG. 4 shows an outer smoking article pack blank according to a second embodiment of the present invention.

FIG. 4 shows an alternative outer blank 81 according to a second embodiment of the present invention. The outer blank 81 of the second embodiment has all the features of the outer blank 1 of FIG. 1. The outer blank 81 of FIG. 4 has an additional side flap 80 depending from longitudinal margin 41 of side panel 32. Thus the outer blank 81 of FIG. 4 has two side flaps depending from the longitudinal margins of side panels 32 and 33. A line of perforation 82 extends longitudinally from the top margin 83 of second main panel 25, across margin 29 into bottom panel 26. The line of perforation 82 extends to, but not beyond, line of perforation 40.

When the outer blank 81 is erected, side flaps 80 and 35 lie against the inner surface of side panels 38 and 39 and are fixed thereto, for example by gluing. When lines of perforation 82 and 40 are broken, the outer blank is free to hinge about the two side hinge lines formed along longitudinal margins 34 and 41. In an alternative arrangement, side flaps 80 and 35 may lie against the outer surface of side panels 38 and 39 when outer blank 81 is erected.

Figure 5:
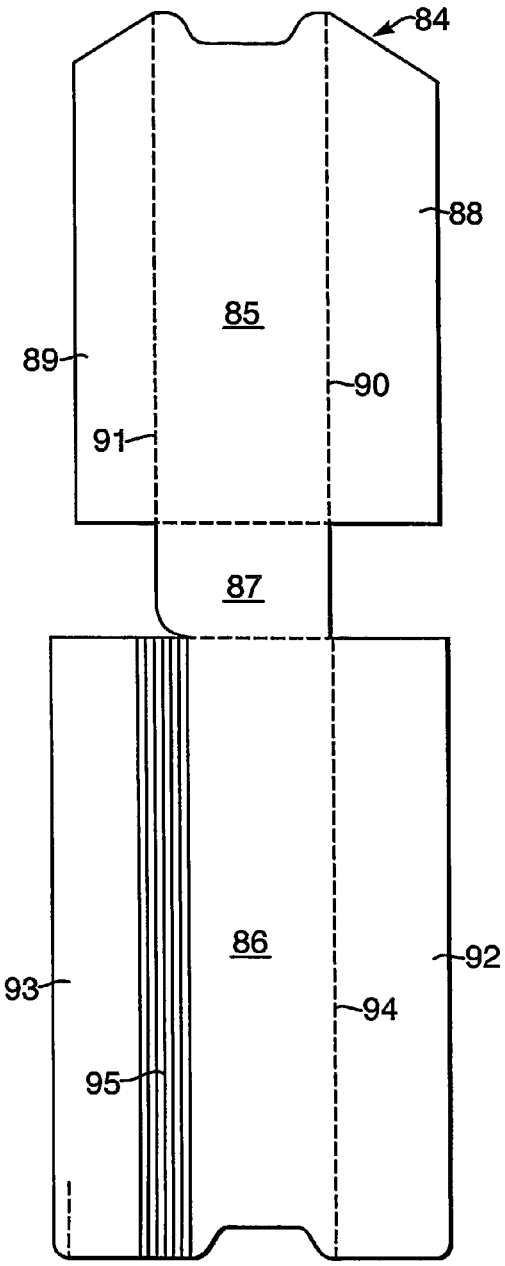
FIG. 5 shows an inner blank to be used in combination with the outer blank of FIG. 4.
Figure 6:
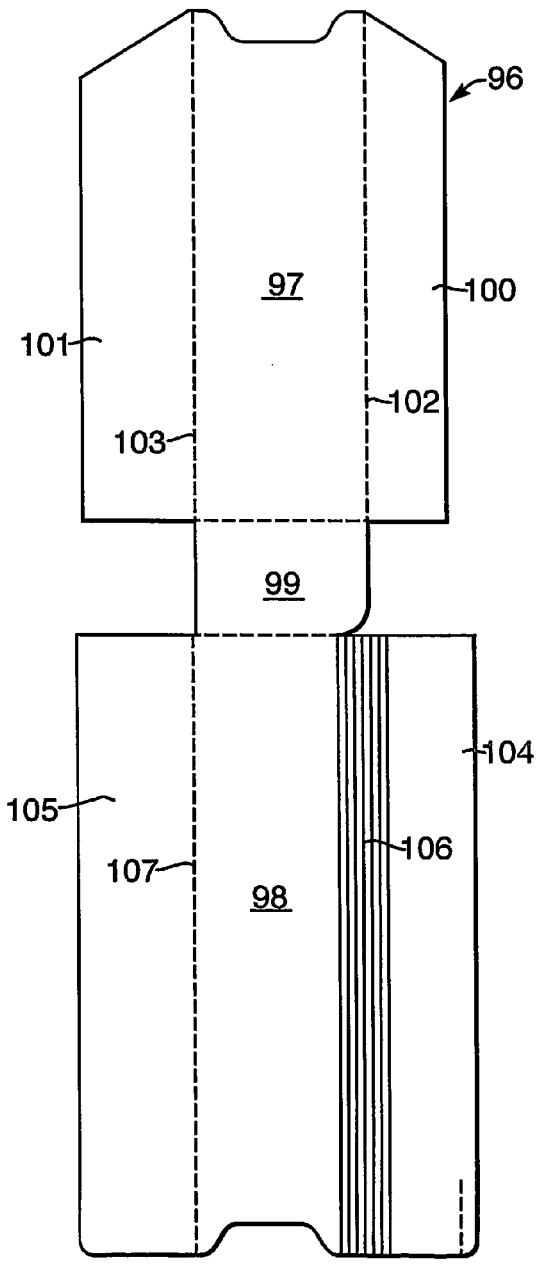
FIG. 6 shows a second inner blank to be used in combination with the outer blank of FIG. 4 and the inner blank of FIG. 5.
Figure 7:
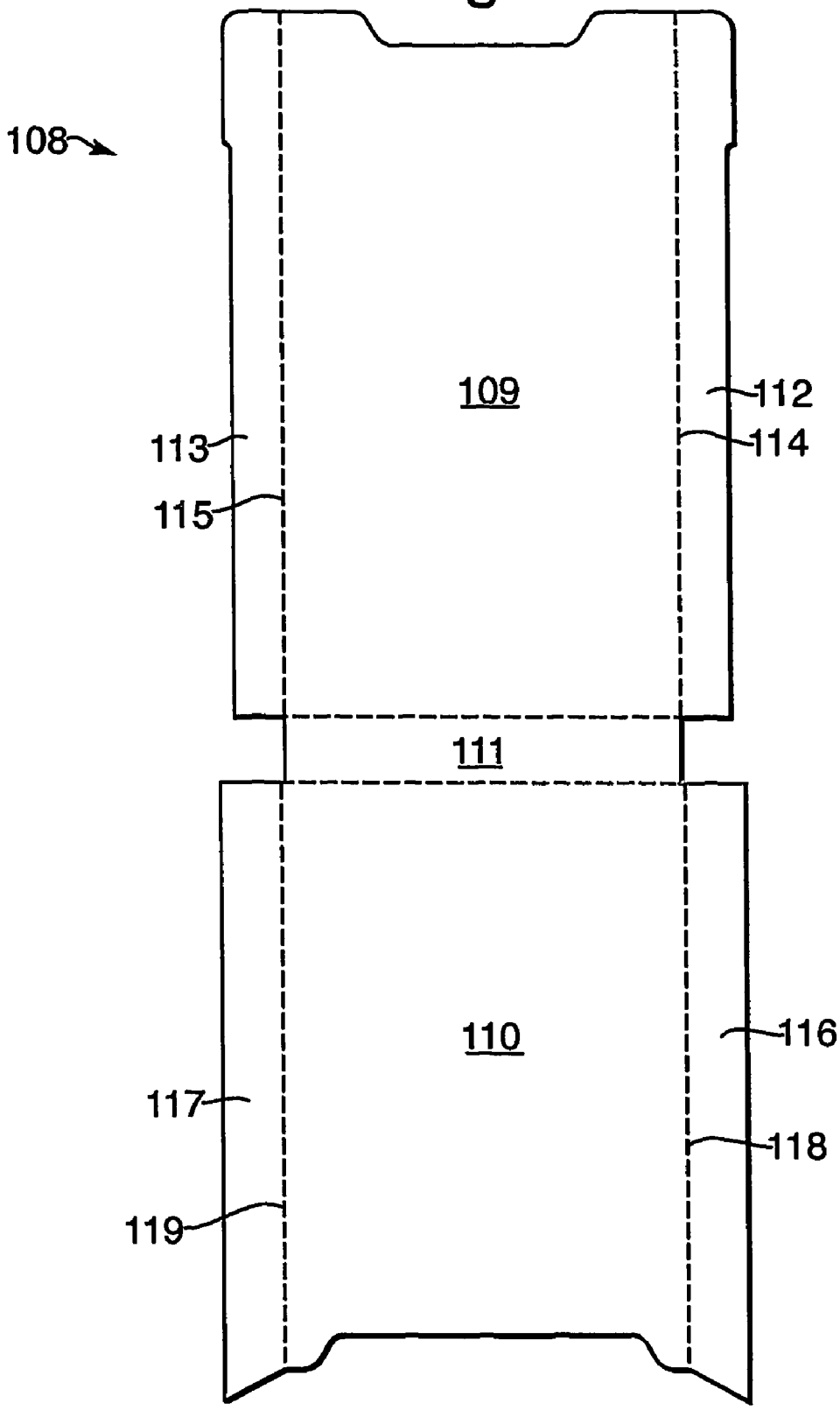
FIG. 7 shows a further inner blank to be used in combination with the outer blank of FIG. 4 and the inner blanks of FIG. 5 and 6.

FIGS. 5, 6 and 7 show inner blanks suitable for use in combination with the outer blank 1 of FIG. 4.

FIG. 5 shows an inner blank 84, comprising main panels 85 and 86, and a bottom panel 87. Main panel 85 has side panels 88 and 89, which side panels (88, 89) depend from longitudinal margins 90 and 91 respectively.

Main panel 86 has side panels 92 and 93, which side panels (92, 93) depend from longitudinal margins 94 and 95.

FIG. 6 shows a further inner blank 96, comprising main panels 97 and 98, and a bottom panel 99. Main panel 97 has side panels 100 and 101 depending from longitudinal margins 102 and 103 respectively.

Main panel 98 has side panels 104 and 105, which side panels have longitudinal margins 106 and 107 from which margins side panels 104 and 105 depend.

FIG. 7 shows a further inner blank 108, comprising main panels 109 and 110, and bottom panel 111. Main panel 109 has side panels 112 and 113 depending from longitudinal margins 114 and 115.

Main panel 110 has side panels 116 and 117, depending from longitudinal margins 118 and 119 respectively.

When assembling a smoking article pack from the outer blank 81 of FIG. 4 and the inner blanks of FIG. 5, 6 and 7, main panel 109 of inner blank 108 is fixed, for example by gluing, to first main panel 24 of outer blank 81. Side panels 112 and 113 are secured by gluing to the inner surfaces of side panels 38 and 39 of outer blank 81.

Main panel 98 of inner blank 96 is secured to the inner surface of a first portion 25*a* of the second main panel of outer blank 81. Side panel 104 of inner blank 96 is secured to the inner surface of side panel 32 of outer blank 81.

Main panel 86 of inner blank 84, is secured to the inner surface of a second portion 25*b* of the second main panel of outer blank 81. Side panel 93 of inner blank 84 is secured to the inner surface of side panel 35 of outer blank 81.

The outer blank 81 and inner blanks 84, 96 and 108 may then be fully assembled to form a smoking article pack. The smoking article pack may then be overwrapped, for example, by cellophane.

It is much by preference that the inner blanks are assembled about bundles of smoking articles before assembly of the outer blank about the inner blanks.

Figure 8:
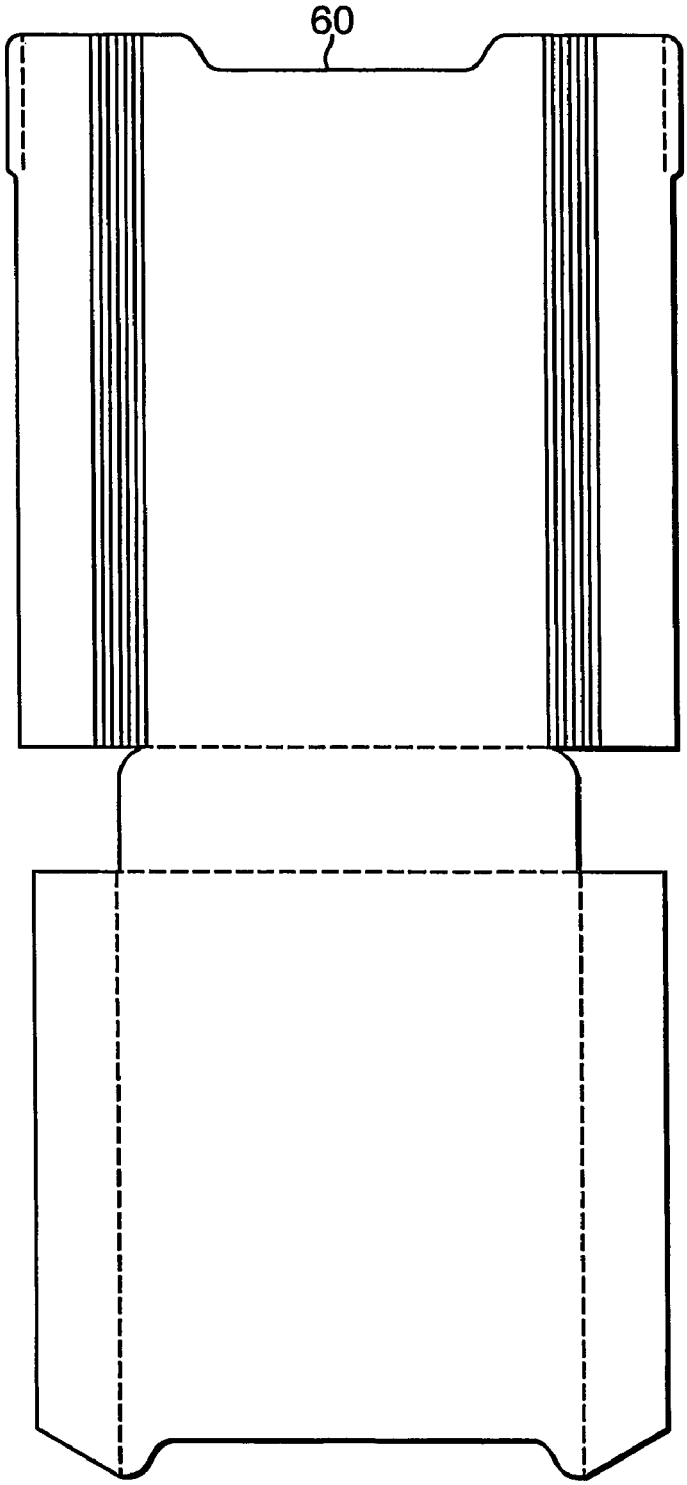
FIG. 8 shows an alternative arrangement of the inner blank of FIG. 2.

FIG. 8 shows an alternative arrangement of the inner blank of FIG. 2. Cut-out portion 60 is of a lesser depth dimension than the corresponding cut-out portion 60 of the inner blank of FIG. 2. It will be apparent to a person skilled in the art that when the outer blank 1 of FIG. 1 is assembled about the inner blanks shown in FIGS. 3 and 8, access to the smoking articles within the assembled pack is initially restricted until the line of perforation 40 of the outer blank 1 is broken and the pack assembly is hinged open about line 34.

The outer and inner blanks represented in the aforegoing Figures may have round, square or bevelled longitudinal margins. The blanks may also be of dimensions suitable for any size of smoking article pack or carton. The outer and inner blanks of the present invention, when used in combination in assembling a smoking article pack, should be suitably dimensioned such that the outer blank may be assembled about a plurality of inner blanks.

The invention claimed is:

1. A smoking article outer pack blank, the blank comprising a lid portion and a base portion, the lid portion and the base portion being interconnected along a hinge line whereas said lid portion forms a hinged lid-pack when the blank is erected, and the base portion comprising a first main panel and a second main panel which face each other when the blank is erected, and a bottom panel, each said main panel being defined by longitudinal side margins, side panels depending from the longitudinal side margins of the first and second main panels, each said side panel extending perpendicularly from a main panel when the blank is erected and each said side panel being flat in its own single plane and having an outer longitudinal margin spaced from said longitudinal side margin of the main panel from which it depends, and a first side flap which is connected by a hinge line to the said outer longitudinal margin of a side panel of one main panel and a second side flap which is connected by a hinge line to said outer longitudinal margin of the opposite side panel on one main panel, each of which first and second side flaps respectively overlaps and lies flat against a surface of an adjacent side panel each of which adjacent side panel surfaces remains wholly within its own single plane, and thereby said first and second side flaps directly connect to their adjacent side panels of the first and second main panels, which adjacent side panels do not overlap each other, when the blank is erected.

2. A smoking article pack blank according to claim 1, wherein each panel has a top margin and a bottom margin.

3. A smoking article pack blank according to claim 1, wherein said bottom panel of the smoking article pack blank comprises at least two bottom panel sections.

4. A smoking article pack blank according to claim 3, wherein said bottom panel comprises two bottom panel sections coextending laterally and joined together along a common line.

5. A smoking article pack blank according to claim 4, wherein said bottom panel sections are joined along a common line of weakening.

6. A smoking article pack blank according to claim 5, wherein said common line of weakening extends from one of the longitudinal margins of the bottom panel to the other longitudinal margin of the bottom panel.

7. A smoking article pack blank according to claim 6, wherein said common line of weakening in said bottom panel extends laterally through said bottom panel between the longitudinal margins of said bottom panel in parallel relation to the top margin and/or the bottom margin of said bottom panel.

8. A smoking article pack blank according to claim 6, wherein said side flaps depend from the outer longitudinal margins of the first and second side panels of said second main panel.

9. A smoking article pack blank according to claim 6, wherein said blank further comprises a second line of weakening, which second line of weakening extends longitudinally from the top margin of said second main panel to the bottom margin of said second main panel and is essentially equidistantly spaced between the longitudinal side margins of said second main panel.

10. A smoking article pack blank according to claim 9, wherein said second line of weakening extends longitudinally in substantially parallel relation to the longitudinal side margins of said second main panel.

11. A smoking article pack blank according to claim 9, wherein said second line of weakening further extends across the bottom margin of said second main panel into said bottom panel and intersects with said common line of weakening, whereby when said common and second lines of weakening are broken, the pack blank is free to hinge about the hinge lines connecting said first and second flaps to the said outer longitudinal margins of said side panels.

12. A smoking article pack blank according claim 9, wherein said second line of weakening is a line of perforation.

13. A smoking article pack blank according to claim 5, wherein said common line of weakening is a line of perforation.

14. A smoking article pack blank according to claim 3, wherein said bottom panel sections are integral with one another.

15. A smoking article pack blank according to claim 14, wherein said bottom panel sections are separable from one another.

16. A smoking article pack blank according to claim 15, wherein said bottom panel sections are separable from one another along a common line of integration.

17. A smoking article pack blank according to claim 16, wherein said common line of integration extends between the opposing longitudinal margins of the bottom panel.

18. A smoking article pack blank according to claim 17, wherein said common line of integration extends between the opposing longitudinal margins of the bottom panel in parallel relation to the top margin and/or the bottom margin of the bottom panel.

19. A smoking article pack blank according to claim 1, wherein said bottom panel has a depth dimension and said side panels have width dimensions, all said dimensions being substantially equal to a multiple of the diameter of a smoking article.

20. A smoking article pack blank according to claim 1, wherein the width dimension of each of the side panels depending from a main panel of the smoking article pack blank is substantially equal to the depth dimension of that bottom panel section adjacent to that main panel, which bottom panel section is delimited by a common line of weakening or a common line of integration in the bottom panel.

21. A smoking article pack blank according to claim 1, wherein said main panels have a common longitudinal axis.

22. A smoking article pack blank according to claim 1, wherein the total depth dimension of said bottom panel is equal to the sum of the width of the side panel depending from the longitudinal margin of the first main panel and the width of a side panel depending from the longitudinal margin of said second main panel.

23. A smoking article pack blank according to claim 1, wherein said hinge line connecting each side flap and its respective adjacent side panel is formed from the common longitudinal margin between the side flap and the adjacent side panel.

24. A smoking article pack blank according to claim 1, wherein said side flaps depend from opposite outer longitudinal margins of a side panel of the same main panel.

25. A smoking article pack blank according to claim 1, wherein, when said blank is erected, one said side flap depends from a longitudinal margin of a side panel of the first main panel and one said side flap overlaps a side panel of the second main panel of the blank.

26. A smoking article pack blank according to claim 25, wherein each said side panel and each said corresponding overlapping side flap are of substantially equal width dimensions.

27. A smoking article pack blank according to claim 1, wherein, when the blank is erected, the outer longitudinal margin of each side panel from which a side flap depends forms a longitudinally extending hinge line in a side wall of the erected blank.

28. A smoking article pack blank according to claim 1 in combination with a plurality of inner blanks, which inner blanks, when erected, are capable of enwrapping a bundle of smoking articles.

29. A smoking article pack assembly comprises a smoking article pack blank according to claim 1 and a plurality of inner blanks, said smoking article pack blank being erectable about said plurality of inner blanks.

30. A smoking article pack assembly according to claim 29, wherein said inner blanks each have at least one main panel.

31. A smoking article pack assembly according to claim 30, wherein each of said inner blanks comprises two main panels.

32. A smoking article pack assembly according to claim 29, wherein when said smoking article pack blank is erected about said plurality of inner blanks, said smoking article pack assembly is maintained in a closed position by means of the lid portion of said pack assembly.

33. A smoking article pack blank according to claim 1 wherein one said main panel is defined by longitudinal side margins each forming a crease when the blank is erected, the other said main panel being defined by longitudinal side margins forming a rounded or beveled surface when the blank is erected.

34. A smoking article pack blank according to claim 1 wherein the total depth dimension of said bottom panel is equal to the sum of the width of the side panel depending from the longitudinal margin of the first main panel and the width of a side panel depending from the longitudinal margin of said second main panel.

* * * * *